US007245840B2

(12) United States Patent
Hwang

(10) Patent No.: US 7,245,840 B2
(45) Date of Patent: Jul. 17, 2007

(54) METHOD AND APPARATUS FOR ESTIMATING THE VOLUME OF TONER CONSUMPTION IN CONSIDERATION OF OVERLAPPING AREAS

(75) Inventor: Hong-Gie Hwang, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 166 days.

(21) Appl. No.: 11/000,154

(22) Filed: Dec. 1, 2004

(65) Prior Publication Data

US 2005/0129419 A1 Jun. 16, 2005

(30) Foreign Application Priority Data

Dec. 11, 2003 (KR) ..... 10-2003-0090035

(51) Int. Cl.
*G03G 15/08* (2006.01)

(52) U.S. Cl. ..... 399/27; 399/42

(58) Field of Classification Search ..... 399/9, 399/24, 25, 27, 38, 40, 42, 49; 358/406, 358/504

See application file for complete search history.

(56) References Cited

U.S. PATENT DOCUMENTS 6,895,193 B2 * 5/2005 Takamatsu et al. ..... 399/27

6,995,858 B2 * 2/2006 Murakami et al. ..... 358/1.16

FOREIGN PATENT DOCUMENTS

| | | |
|---|---|---|
| EP | 0 587 172 A1 | 3/1994 |
| JP | 04-330472 | 11/1992 |
| JP | 10-239980 | 9/1998 |
| JP | 2002-189385 | 7/2002 |

* cited by examiner

*Primary Examiner*—Hoan Tran
(74) *Attorney, Agent, or Firm*—Roylance, Abrams, Berdo & Goodman, L.L.P.

(57) ABSTRACT

Provided is a method and apparatus for accurately estimating the volume of toner consumption of a laser printer by subtracting the volume of toner consumption corresponding to overlapping areas between adjacent bits of video data sequentially input by the bit from an average volume of toner consumption per bit. The apparatus includes an effective video data generator receiving video data and generating effective video data, a first storing unit receiving and temporarily storing the effective video data, and a toner consumption calculator receiving the effective video data from the first storing unit and calculating the volume of toner consumption per bit. The toner consumption calculator calculates the volume of toner consumption per bit by sequentially receiving the effective video data by the bit and subtracting the volume of toner consumption corresponding to overlapping areas between a bit and its adjacent bits from an average volume of toner consumption per bit.

9 Claims, 5 Drawing Sheets

METHOD AND APPARATUS FOR ESTIMATING THE VOLUME OF TONER CONSUMPTION IN CONSIDERATION OF OVERLAPPING AREAS

BACKGROUND OF THE INVENTION

This application claims priority under 35 U.S.C. §119(a) of Korean Patent Application No. 2003-90035, filed on Dec. 11, 2003, in the Korean Intellectual Property Office, the disclosure of which is incorporated herein by reference in its entirety.

1. Field of the Invention

The present invention relates to a method and apparatus for estimating the volume of toner consumption. More particularly, the present invention relates to a method and apparatus for accurately estimating the volume of toner consumption of an electrophotographic image forming device, such as a laser printer, by subtracting the volume of toner consumption corresponding to overlapping areas between adjacent dots.

2. Description of the Related Art

Generally, a laser printer projects a laser beam emitted by a laser diode onto a photosensitive drum in response to a video signal of an input image. Toner is attached to the surface of the photosensitive drum, and the attached toner is attached to a sheet of paper, thereby forming an image, such as a character or a picture.

FIG. 1 is a block diagram of a conventional apparatus 100 for estimating the volume of toner consumption. The apparatus 100 includes an effective dot generator 110, an effective dot clock calculator 120, and a storing unit 130. Referring to FIG. 1, the effective dot generator 110 receives a video clock signal (VCLK) and video data, and generates effective dots at a high level. The effective dot clock calculator 120 accumulates and counts the effective dots generated by the effective dot generator 110 in response to a printing synchronous signal. The effective dot clock calculator 120 multiplies the number of the accumulated effective dots by the volume of toner consumption per dot and outputs a total accumulated volume of toner consumption. The storing unit 130 stores the total accumulated volume of toner consumption calculated by the effective dot clock calculator 120.

This method of estimating the volume of toner consumption does not consider that the volume of toner consumption corresponding to overlapping areas between adjacent dots should be subtracted from the average volume of toner consumption per dot. Hence, the volume of toner consumption is inaccurately calculated.

Another method of calculating the volume of toner consumption is disclosed in European Patent Publication No. 0587172, the entire contents of which are incorporated herein by reference. In this method, the integral volume of toner consumption is calculated by detecting the number of consecutive dots and the number of the consecutive dots is multiplied by the volume of toner consumption per dot. Integral rates are adjusted according to the intensity of an image (i.e., an increase in the number of the consecutive dots changes the integral rate).

To solve the problems discussed above and others, the embodiments of the present invention provide a method and apparatus for accurately estimating the volume of toner consumption of an electrophotographic image forming device, such as a laser printer, by subtracting the volume of toner corresponding to overlapping areas between adjacent bits of video data sequentially input by the bit, from an average volume of toner consumption per bit.

SUMMARY OF THE INVENTION

According to an aspect of the present invention, there is provided an apparatus for estimating the volume of toner consumption of a laser printer by receiving a video clock signal, video data, and a video window signal, and considering overlapping areas between adjacent bits. The apparatus includes an effective video data generator for receiving video data and generating effective video data, a first storing unit for receiving and temporarily storing the effective video data, and a toner consumption calculator for receiving the effective video data from the first storing unit and calculating the volume of toner consumption per bit.

The apparatus can further include a second storing unit for accumulating and storing the volume of toner consumption per bit calculated by the toner consumption calculator. The effective video data generator generates the effective video data by detecting the state of the video data at a particular edge of the video clock signal. The effective video data denotes data in an effective section of the video window signal. The toner consumption calculator calculates the volume of toner consumption per bit by sequentially receiving the effective video data and subtracting the volume of toner consumption corresponding to overlapping areas between adjacent bits from an average volume of toner consumption per bit.

According to another aspect of the present invention, there is provided a method of estimating the volume of toner consumption of a laser printer by receiving a video clock signal, video data, and a video window signal, and considering overlapping areas between adjacent bits. The method includes the steps of receiving video data, generating effective video data and calculating the volume of toner consumption per bit in consideration of adjacent bits of the effective video data.

The method can further include the steps of accumulating and storing the volume of toner consumption per bit. The steps of receiving video data and generating effective video data comprises generating the effective video data by detecting the state of the video data at a particular edge of the video clock signal. The effective video data can denote data in an effective section of the video window signal.

The step of calculating the volume of toner consumption per bit in consideration of adjacent bits of the effective video data comprises receiving the effective video data and calculating the volume of toner consumption per bit by subtracting the volume of toner consumption corresponding to overlapping areas between adjacent bits from an average volume of toner consumption per bit. The volume of toner consumption corresponding to overlapping areas between the adjacent bits can be determined experimentally.

In the method according to an embodiment of the present invention, the volume of toner consumption can be more accurately calculated by subtracting the volume of toner consumption corresponding to overlapping areas between adjacent bits, thereby enabling an accurate prediction of toner consumption.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
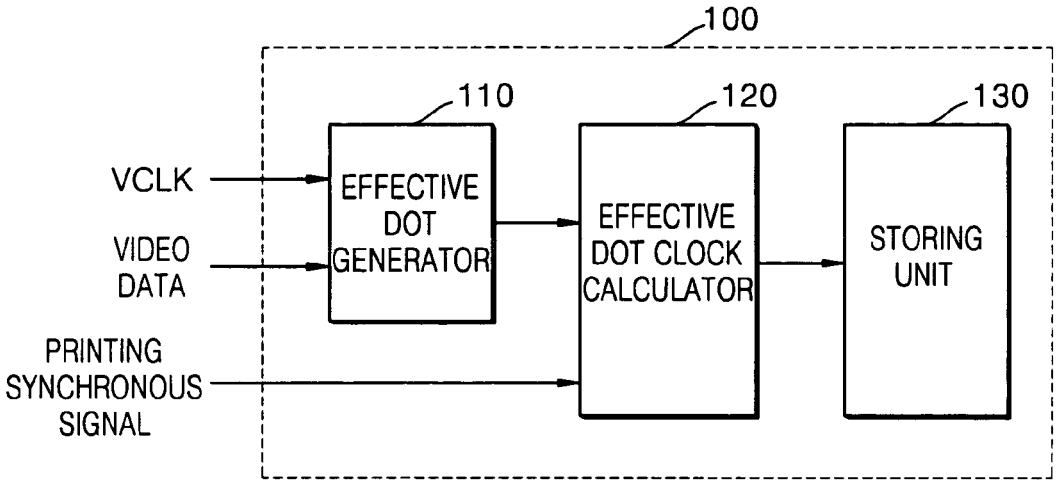
FIG. 1 (PRIOR ART)
FIG. 1 is a block diagram of a conventional apparatus for estimating the volume of toner consumption.

The present invention will now be described more fully with reference to the accompanying drawings, in which exemplary embodiments of the present invention are shown. The invention may, however, be embodied in many different forms and should not be construed as being limited to the embodiments set forth therein. Like reference numerals in the drawings denote like elements, and thus their description will be omitted.

Figure 2:
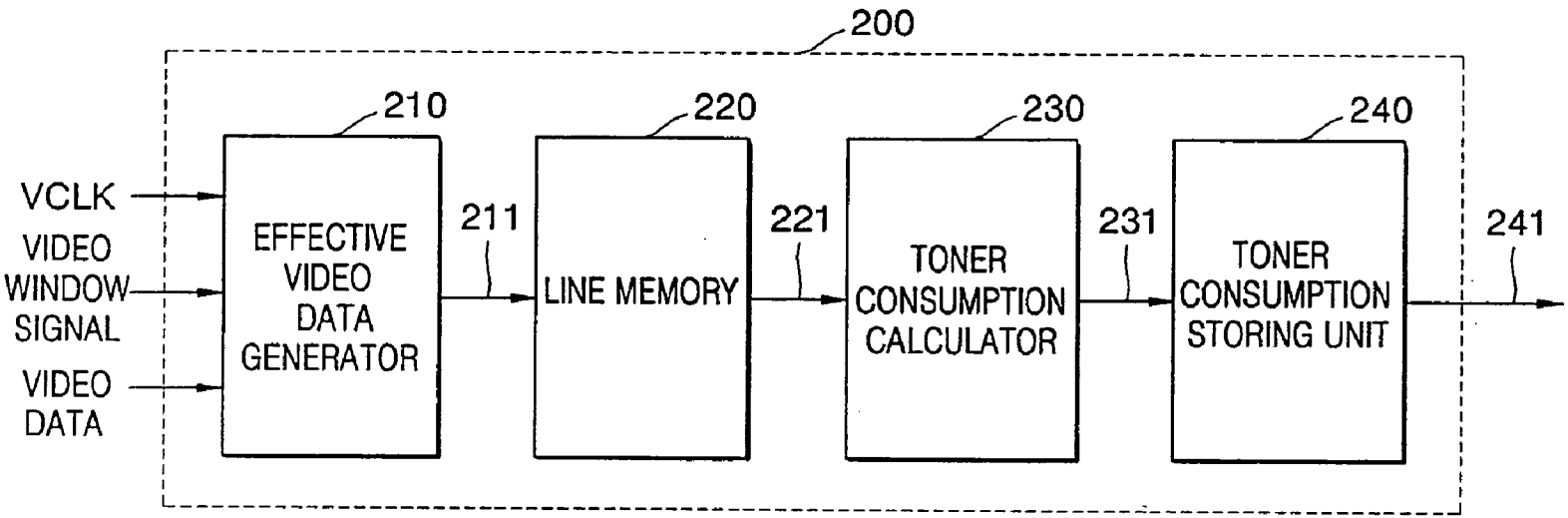
FIG. 2 is a block diagram of an apparatus for estimating the volume of toner consumption according to an embodiment of the present invention.

FIG. 2 is a block diagram of an apparatus 200 for estimating the volume of toner consumption according to an embodiment of the present invention. The apparatus 200 includes an effective video data generator 210, a line memory 220, a toner consumption calculator 230, and a toner consumption storing unit 240.

Referring to FIG. 2, the effective video generator 210 receives a video clock signal (VCLK), video data, and a video window signal, and extracts effective video data 211 from the video data. Not all video data transmitted to a laser scanning unit (not shown) is printed on a sheet of paper. The video window signal determines which video data is the effective video data 211 and indicates which portion of a sheet of paper should be printed in consideration of right and left margins of the paper. The video window signal will be described below in greater detail with reference to FIG. 3.

Figure 4:
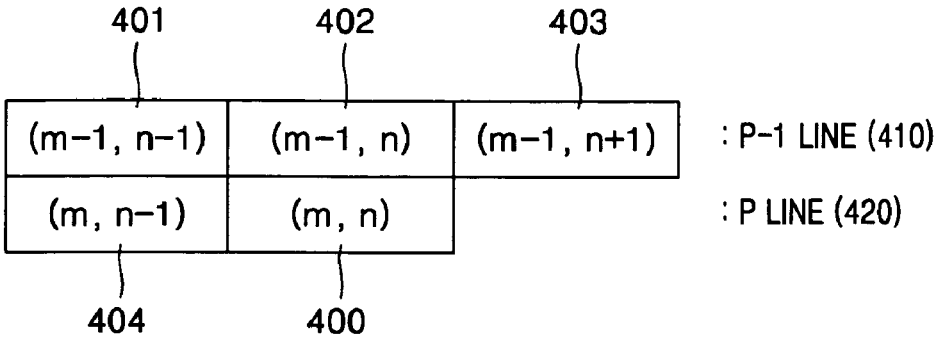
FIG. 4 illustrates a two-line memory to which bits are sequentially input.
Figure 5:
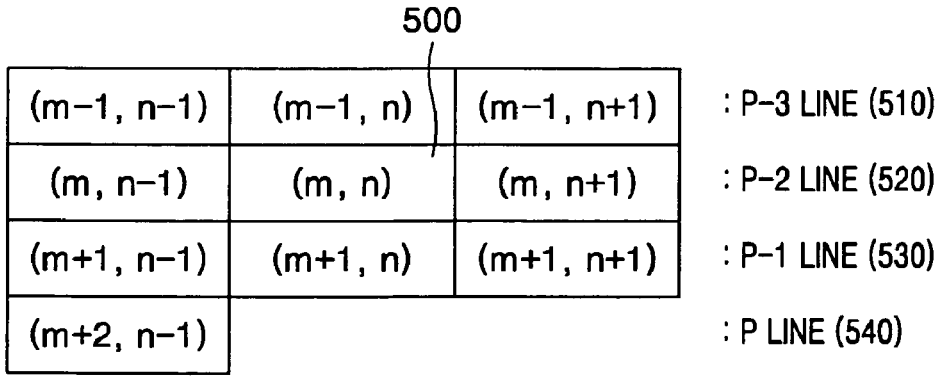
FIG. 5 illustrates a four-line memory to which bits are sequentially input.

The line memory 220 receives the effective video data 211 from the effective video data generator 210 and stores the effective video data 211. The line memory 220 according to an embodiment of the present invention includes a two-line memory and a four-line memory. The two-line memory is illustrated in FIG. 4, and the four-line memory is illustrated in FIG. 5. The line memory 220 sequentially stores the effective video data 211. The two-line memory has the capacity to store two-line video data, and the four-line memory has the capacity to store four-line video data.

The toner consumption calculator 230 receives effective video data 221 from the line memory 220 and calculates the actual volume of toner consumption per bit by subtracting the volume of toner consumption corresponding to overlapping areas between adjacent high-level bits from an average volume of toner consumption per bit. The volume of toner consumption corresponding to the overlapping areas can be obtained experimentally.

The toner consumption storing unit 240 accumulates and stores the volume of toner consumption per bit 231 output from the toner consumption calculator 230. The volume of toner consumption thus stored is compared with a predetermined volume of toner. When the volume of toner consumption exceeds the predetermined volume of toner, a user can be informed of a shortage of toner.

Figure 3:
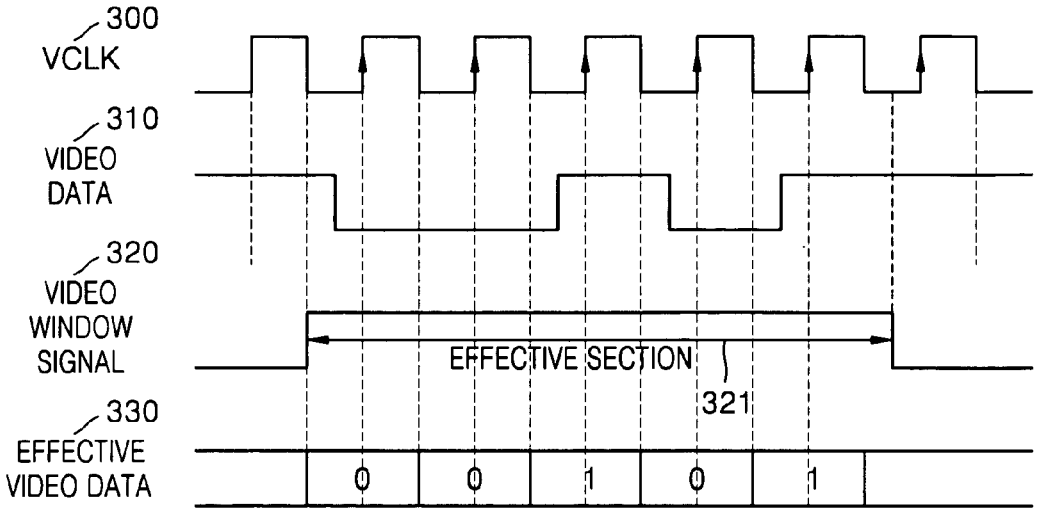
FIG. 3 is a timing diagram of several signals input to the apparatus of FIG. 2.

FIG. 3 is a timing diagram of a variety of signals input to the apparatus 200 of FIG. 2. The signals are a VCLK 300, video data 310, and a video window signal 320. The effective video data 330 is also shown in FIG. 3.

Referring to FIG. 3, the VCLK 300 is used as a standard clock signal having a known duty cycle. The level of the video data 310 is determined at a particular edge of the VCLK 300. According to an embodiment of the present invention, the effective video data 330 is generated at a rising edge of the VCLK 300 (as indicated by the arrows on the VCLK 300 signal). The video window signal 320 defines a high-level section as an effective section 321. In the effective section 321, the video data 310 becomes the effective video data 330. The video window signal 320 is generated in consideration of margins of a sheet of paper. Therefore, the margins of a sheet of paper are maintained by the video window signal 320.

The effective video data 330 in the effective section 321 of FIG. 3 is "00101." Only the effective video data 330 is transmitted to the line memory 220 of FIG. 2 and used for calculating and estimating the volume of toner consumption.

FIG. 4 illustrates the two-line memory to which bits are sequentially input. The two-line memory includes a P-1 line 410 and a P line 420. The two-line memory has the capacity to store two-line video data. If a bit of the video data being input to the two-line memory is (m, n) 400, bits adjacent to and which will probably overlap with this bit are (m−1, n−1) 401, (m−1, n) 402, and (m−1, n+1) 403 in the P-1 line 410 and (m, n−1) 404 in the P line 420. Since the number of dots adjacent to the (m, n) 400 is four, the two-line memory may be called a "four-dot matrix" for the sake of convenience.

When the levels of the (m−1, n−1) 401, the (m−1, n) 402, (m−1, n+1) 403, and 404 (m, n−1) are high, these bits may be used for determining the volume of toner consumed in printing the (m, n) 400. For example, it is assumed that an average volume of toner consumption per bit is 100. If the bits do not overlap, the volume of toner consumed in printing the (m, n) 400 is 100. If the bits do overlap, however, their volume will be different. For example, if the (m−1, n−1) 401 and the (m−1, n) 402 are "one" indicating a high level, and the (m−1, n+1) 403 and the (m, n−1) 404 are "zero" indicating a low level, and the volume of toner consumption of each of the (m−1, n−1) 401 and the (m−1, n) 402 bits, which will be subtracted since they overlap with the bit (m, n) 400, is five, the actual volume of toner consumed in printing the (m, n) 400 is 100-(5+5)=90.

In accordance with the embodiment of the present invention, the volume of toner consumption per bit according to the number of adjacent bits and the degree of overlap can be stored in a look-up table. Using this look-up table as a reference, the actual volume of toner consumed in printing one bit can be accurately calculated, taking overlapping areas into account. The volume of toner consumption to be subtracted due to overlapping areas can be determined experimentally.

FIG. 5 illustrates the four-line memory to which bits are sequentially input. The four-line memory includes a P-3 line 510, a P-2 line 520, a P-1 line 530, and a P line 540. The exemplary four-line memory illustrated in FIG. 5 operates in the same manner as the two-line memory of FIG. 4. The difference is that the four-line memory has the capacity to store four-lines of effective video data. When a bit being input to the four-line memory is (m+2, n−1), the volume of toner consumed in printing (m, n) 500 will be calculated. Since the number of bits adjacent to the bit (m, n) 500 is eight, the four-line memory may be called an "8-dot matrix" for the sake of convenience.

While four adjacent bits are considered in the "4-dot matrix" of FIG. 4, eight adjacent bits are considered in the "8-dot matrix" of FIG. 5. Therefore, the four-line memory (i.e., the "8-dot matrix") can estimate the volume of toner consumption more accurately than the two-line matrix.

Figure 6:
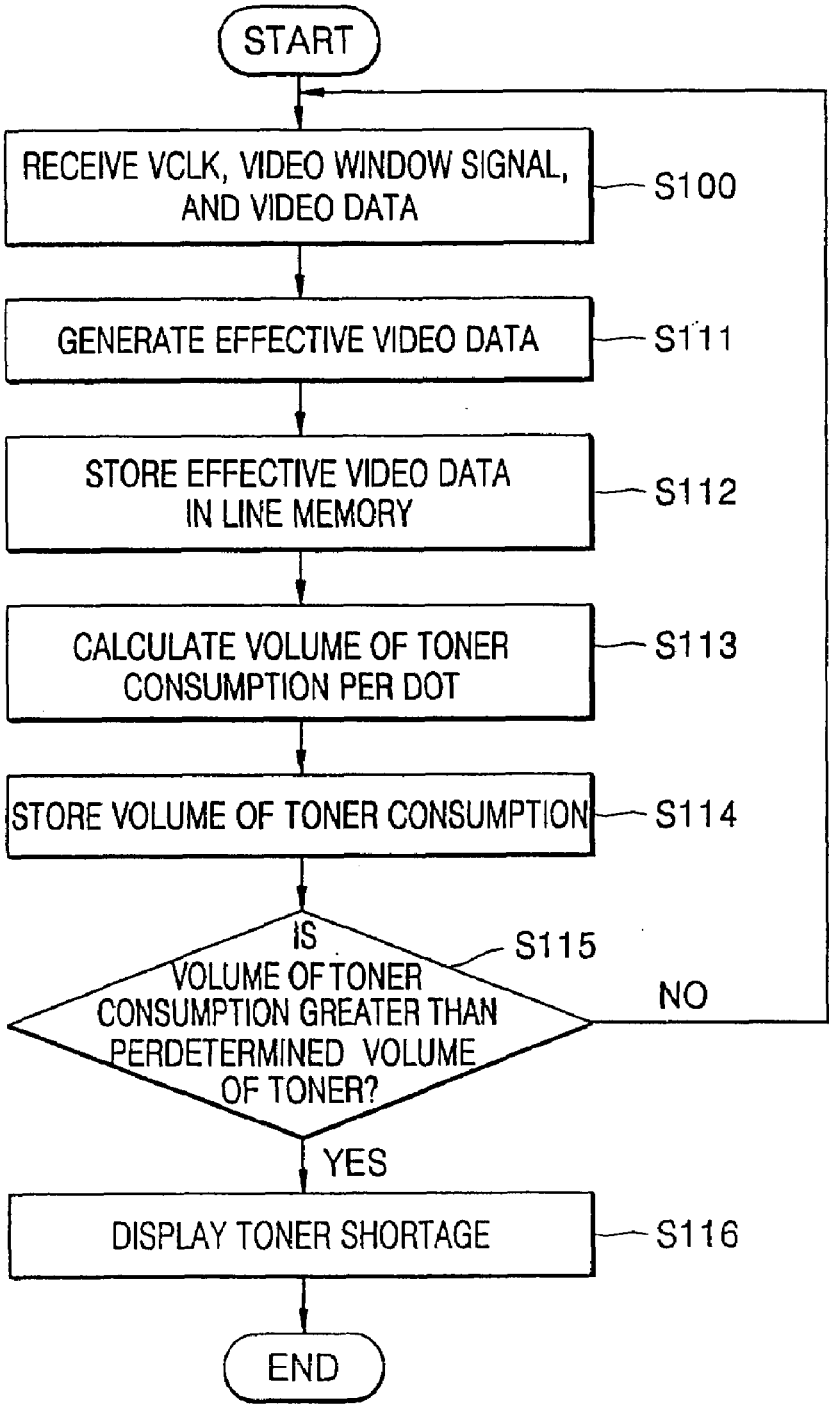
FIG. 6 is a flow chart illustrating a method of estimating the volume of toner consumption according to an embodiment of the present invention.

FIG. 6 is a flow chart illustrating a method of estimating the volume of toner consumption according to an embodiment of the present invention. The method includes the steps of receiving signals (step S110), generating effective video data (step 111), storing the effective vide data (step S112), calculating the volume of toner consumption per dot (step S113), storing the volume of toner consumption (step S114), determining the remaining volume of toner (decision step S115), and displaying a shortage of toner (step S116).

Referring to FIG. 6, as described with reference to FIG. 2, the effective video data generator 210 receives the VCLK signal, the video window signal, and the video data in step S110.

In step S111, as described with reference to FIG. 3, the effective video data generator 210 then generates the effective video data 330 by detecting the level of the video data 310 (i.e., high or low) at the rising edge of the VCLK 300. In this case, only the video data 310 in the effective section 321 of the video window signal 320, becomes the effective video data 330 (Operation 111). This is the section where the level of the video window signal 320 is high.

In step S112, the effective video data 330 is stored in the line memory. Two-line effective video data is stored in the two-line memory and four-line effective video data is stored in the four-line memory. As described above, in the "8-dot matrix," the volume of toner consumption corresponding to overlapping areas between a bit and its adjacent eight dots are considered. As a result, the volume of toner consumption per bit can be more accurately calculated than in the "four-dot matrix."

In step S113, the toner consumption calculator 230 sequentially receives bits from the line memory 220 and calculates the volume of toner consumption per bit. The volume of toner consumption per bit is obtained by subtracting the volume of toner consumption in consideration of the number of adjacent high-level bits and overlapping areas, from an average volume of toner consumption per bit. As described above, the volume of toner consumption per bit according to the number of adjacent bits and the degree of overlap can be determined experimentally and stored in the look-up table.

The volume of toner consumption calculated per bit is accumulated and stored in the toner consumption storing unit 240 (step S114). Then, the accumulated volume of toner consumption is compared with a predetermined volume of toner in decision step S115.

If the accumulated volume of toner consumption exceeds the predetermined volume of toner, the toner has run out or there is little left ("Yes" path from decision step S115). Therefore, printing cannot be done properly. In this case, the status of toner can be displayed to inform a user of a shortage of toner in step S116. If the volume of toner consumption is less than or equal to the predetermined volume of toner, then the method goes back to step S110 ("No" path from decision step S115).

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for estimating the volume of toner consumption of an electrophotographic image forming device by receiving a video clock signal, video data, and a video window signal, and considering overlapping areas between adjacent printed bits, the apparatus comprising:

an effective video data generator adapted to receive video data and generate effective video data;

a first storing unit adapted to receive and temporarily store the effective video data; and a toner consumption calculator adapted to receive the effective video data from the first storing unit and calculate the volume of toner consumption per bit.

2. The apparatus of claim 1, further comprising a second storing unit adapted to accumulate and store the volume of toner consumption per bit calculated by the toner consumption calculator.

3. An apparatus for estimating the volume of toner consumption of an electrophotographic image forming device by receiving a video clock signal, video data, and a video window signal, and considering overlapping areas between adjacent bits, the apparatus comprising:

an effective video data generator adapted to receive video data and generate effective video data;

a first storing unit adapted to receive and temporarily store the effective video data; and a toner consumption calculator adapted to receive the effective video data from the storing unit and calculate the volume of the consumption per bit;

wherein the effective video data generator generates the effective video data by detecting the state of the video data at a particular edge of the video clock signal, and the effective video data denotes data in an effective section of the video window signal.

4. An apparatus for estimating the volume of toner consumption of an electrophotographic image forming device by receiving a video clock signal, video data, and a video window signal, and considering overlapping areas between adjacent bits, the apparatus comprising:

an effective video data generator adapted to receive video data and generate effective video data;

a first storing unit adapted to receive and temporarily store the effective video data; and a toner consumption calculator adapted to receive the effective video data from the first storing unit and calculate the volume of toner consumption bit;

wherein the toner consumption calculator calculates the volume of toner consumption per bit by sequentially receiving the effective video data by the bit and subtracting the volume of toner consumption corresponding to overlapping areas between adjacent bits from an average volume of toner consumption per bit.

5. A method of estimating the volume of toner consumption of an electrophotographic image forming device by receiving a video clock signal, video data, and a video window signal, and considering overlapping areas between adjacent printed bits, the method comprising:

receiving video data and generating effective video data; and calculating the volume of toner consumption per bit in consideration of adjacent printed bits of the effective video data.

6. The method of claim 5, further comprising:

accumulating and storing the volume of toner consumption per bit.

7. A method of estimating the volume of toner consumption of an electrophotographic image forming device by receiving video clock signal, video data, and a video window signal, and considering overlapping areas between adjacent bits, the method comprising:

receiving video data and generating effective video data; and calculating the volume of toner consumption per bit in consideration of adjacent bits of the effective video data;

wherein the step of receiving video data and generating effective video data comprises:

generating the effective video data by detecting the state of the video data at a particular edge of the video clock signal, wherein the effective video data denotes data in an effective section of the video window signal.

8. A method of estimating the volume of toner consumption of an electrophotographic image forming device by receiving a video clock signal, video data, and a video window signal, and considering overlapping areas between adjacent bits, the method comprising:

receiving video data and generating effective video data; and calculating the volume of toner consumption per bit in consideration of adjacent bits of the effective video data;

wherein the step of calculating the volume of toner consumption per bit in consideration of adjacent bits of the effective video data comprises:

receiving the effective video data by the bit; and calculating the volume of toner consumption per bit by subtracting the volume of toner consumption corresponding to overlapping areas between a bit and its adjacent bits, from an average volume of toner consumption per bit.

9. The method of claim 8, wherein the volume of toner consumption corresponding to overlapping areas between the adjacent bits is determined experimentally.

* * * * *